US011201380B2

(12) United States Patent
Kim et al.

(10) Patent No.: US 11,201,380 B2
(45) Date of Patent: Dec. 14, 2021

(54) CAVITY FILTER ASSEMBLY

(71) Applicant: KMW INC., Hwaseong-si (KR)

(72) Inventors: Joung-hoe Kim, Hwaseong-si (KR); Sung Bae Park, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 16/879,767

(22) Filed: May 21, 2020

(65) Prior Publication Data

US 2020/0287260 A1 Sep. 10, 2020

Related U.S. Application Data

(63) Continuation of application No. PCT/KR2018/014385, filed on Nov. 21, 2018.

(30) Foreign Application Priority Data

Nov. 24, 2017 (KR) ..... 10-2017-0158947

(51) Int. Cl.
*H01P 1/20* (2006.01)
*H01P 1/205* (2006.01)
(Continued)

(52) U.S. Cl.
CPC ..... *H01P 1/2053* (2013.01); *H01P 1/201* (2013.01); *H01P 1/202* (2013.01); *H01P 1/203* (2013.01); *H01P 1/20318* (2013.01)

(58) Field of Classification Search
CPC ..... H01P 1/201; H01P 1/202; H01P 1/203; H01P 1/20309; H01P 1/20318;
(Continued)

(56) References Cited

U.S. PATENT DOCUMENTS 6,255,920 B1 7/2001 Ohwada et al.
6,278,341 B1 * 8/2001 Lindqvist ..... H01P 1/2135 333/126
(Continued)

FOREIGN PATENT DOCUMENTS

CN 205081206 U 3/2016
CN 106025465 A 10/2016
(Continued)

OTHER PUBLICATIONS

International Search Report for PCT/KR2018/014385 dated Mar. 15, 2019 and its English translation.
(Continued)

*Primary Examiner* — Stephen E. Jones

(57) ABSTRACT

The present disclosure provides a cavity filter assembly installed with an RF filter having an empty area formed between the RF filter and a cavity filter body serving as a ground to reduce the parasitic capacitance by forming the cavity filter body with a first pocket portion configured to install the RF filter and a second pocket portion within the first pocket portion in a position to overlap a transmission line, thereby reducing the insertion loss of the RF filter, which when serving as a low-pass filter, can position the harmonics in the stopband further away from the cutoff frequency and thus effect improved frequency characteristics of the low-pass filter through improvements of, for example, the frequency characteristics in the stopband.

18 Claims, 14 Drawing Sheets

(51) Int. Cl.
*H01P 1/201* (2006.01)
*H01P 1/203* (2006.01)
*H01P 1/202* (2006.01)

(58) Field of Classification Search
CPC .. H01P 1/20327; H01P 1/20336; H01P 1/205; H01P 1/2053; H01P 1/208; H01P 1/2082
USPC ..... 333/202, 203, 204, 206, 207, 212, 219, 333/219.1, 222, 223, 227
See application file for complete search history.

(56) References Cited

U.S. PATENT DOCUMENTS

| | | | |
|---|---|---|---|
| 2006/0114083 | A1 | 6/2006 | Lee et al. |
| 2015/0042419 | A1 | 2/2015 | Cho et al. |
| 2015/0333386 | A1 | 11/2015 | Kaneda et al. |

FOREIGN PATENT DOCUMENTS

| | | | |
|---|---|---|---|
| KR | 10-1266945 | B1 | 5/2013 |
| KR | 10-2013-0111399 | A | 10/2013 |
| KR | 10-1360917 | B | 2/2014 |
| KR | 10-2016-0096458 | A | 8/2016 |
| KR | 10-2017-0004235 | A | 1/2017 |

OTHER PUBLICATIONS

G.L. Matthaei et al., Microwave Filters, Impedance-Matching Networks, and Coupling Structures, 1962.
Office action dated Mar. 5, 2021 from Chinese Patent Office for Chinese Application No. 201880074657.9 and its English translation.

* cited by examiner (a) Conventionally Designed

Q-Factor Calculation

H-Field data: Mode 1

| Material/Solid | Conductivity | Mue | Loss/W | Loss/% | Q |
|---|---|---|---|---|---|
| **Cond. Enclosure** | 5.8000e+07 | 1 | 9.7176e+06 | 12.7 | 1.6786e+03 |
| PEC | 5.8000e+07 | 1 | 1.2390e+07 | 16.2 | 1.3165e+03 |
| Copper (annealed) | 5.8000e+07 | 1 | 8.2593e+06 | 10.8 | 1.9750e+03 |
| **Sum of Surface Losses** | | | 3.0367e+07 | 39.7 | 5.3716e+02 |
| **Volume Losses** | | | 4.6165e+07 | 60.3 | 3.5334e+02 |
| **Sum** | | | 7.6532e+07 | | 2.1314e+02 |

(b) Presently Designed

Q-Factor Calculation

H-Field data: Mode 1

| Material/Solid | Conductivity | Mue | Loss/W | Loss/% | Q |
|---|---|---|---|---|---|
| **Cond. Enclosure** | 5.8000e+07 | 1 | 8.8379e+06 | 11.7 | 1.9576e+03 |
| PEC | 5.8000e+07 | 1 | 1.1772e+07 | 15.6 | 1.4697e+03 |
| Copper (annealed) | 5.8000e+07 | 1 | 9.9481e+06 | 13.2 | 1.7391e+03 |
| **Sum of Surface Losses** | | | 3.0558e+07 | 40.5 | 5.6617e+02 |
| **Volume Losses** | | | 4.4807e+07 | 59.5 | 3.8613e+02 |
| **Sum** | | | 7.5365e+07 | | 2.2956e+02 |

*FIG. 14*

CAVITY FILTER ASSEMBLY

CROSS-REFERENCE TO RELATED APPLICATION

This application is a continuation of International Application No. PCT/KR2018/014385, filed on Nov. 21, 2018, which claims priority to Korean Patent Application No. 10-2017-0158947, filed on Nov. 24, 2017, the disclosures of which are incorporated by reference herein in their entirety.

TECHNICAL FIELD

The present disclosure in some embodiments relates to a cavity filter assembly, including a radio frequency (RF) filter.

BACKGROUND

The statements in this section merely provide background information related to the present disclosure and do not necessarily constitute prior art.

An RF filter of a cavity structure has a boxy configuration formed of a metallic conductor provided internally with a resonance unit composed of conductive resonant rods to permit an electromagnetic field of natural frequency to exist exclusively, thereby distinctively passing only a characteristic frequency of an ultra-high frequency by resonance. The band-pass filter of the cavity structure has a low insertion loss. It is advantageously used for high power applications and thus as a filter of a mobile communication base station antenna in various ways.

The cavity filter includes an RF terminal in which an RF signal line is connected through a connector. Inside the cavity filter, a low-pass filter is arranged for connecting the RF terminal and the internal resonance rod. A low-pass filter for handling signals in a range of several GHz is configured in a microstrip form, and a characteristic of a low-pass filter affects the performance of an RF filter of a cavity structure.

A commercially available low-pass filter composed of a coaxial conductor having a stepped-impedance is widely employed in base stations for a service such as wireless communications and mobile communications, and the low-pass filter of this type comes to have a very extended physical length along with its order increased for removing harmonics. FIG. 1 shows a coaxial type low-pass filter disclosed in "Microwave Filters, Impedance-Matching Networks, and Coupling Structures" (pp. 35-374) by G. L. Matthaei et al. 1962, which provided the basic structure for succeeding techniques introduced to improve filter characteristics in various forms. For example, U.S. Pat. No. 6,255,920 discloses a technique for reducing harmonics by placing an open stub between stepped-impedance sections 910. Additionally, with reference to FIG. 2, Korean Patent No. 10-1360917 discloses a low-pass filter having a short length while reducing harmonics by changing the fringing capacitance characteristics of stepped-impedance sections by transforming the middle between the stepped-impedance sections from a conventional cylindrical shape to a cone shape 920 and the like.

When considering the mobile communication advancement adding abruptly to the increasing number of channels to be processed by its base station as well as the environment where a base station is installed, such as a building rooftop, a high structure, etc., the relevant components need to be more compact, lighter, and performance-enhanced. Yet, a low-pass filter having a stepped-impedance of a coaxial type suffers from a limitation on miniaturization.

DISCLOSURE

Technical Problem

The present disclosure in some embodiments seeks to improve the performance of a cavity filter by improving a low-pass filter characteristic of an ultra-high frequency band configured in a microstrip form. In particular, the present disclosure aims to reduce insertion loss and to improve a frequency cutoff characteristic of a stopband by reducing parasitic capacitance between a transmission line and a ground.

SUMMARY

At least one embodiment of the present disclosure provides a cavity filter assembly including a hollow container having a first pocket portion formed on one surface of a cavity filter included and a second pocket portion formed in a predetermined region of a bottom surface of the first pocket portion, and at least one or more resonant rods positioned within the hollow container.

The hollow container may further include at least one or more through-holes formed in the other regions of the bottom surface of the first pocket portion.

The RF connection member may include a dielectric bush assembled to the through-hole, and a pin member assembled to the dielectric bush and connected to the RF filter.

The RF filter may have one end connected to the resonant rod by the pin member disposed of adjacent to the resonant rod.

The RF filter may have the other end to which an external RF signal is linked through the pin member connected with the other end of the RF filter.

The RF filter may include a low-pass filter.

The RF filter may include a bandpass filter.

The low-pass filter may include a dielectric material substrate, a transmission line established in a microstrip form on one surface of the dielectric material substrate, impedance matching sections disposed at both ends of the transmission line, at least one open stub disposed between the impedance matching sections and connected to the transmission line, a ground pattern formed on the other surface of the dielectric material substrate and an open portion formed by removing at least a portion of the ground pattern and overlapping an area of the transmission line.

The open portion may be disposed to overlap an entire area of the transmission line.

The open portion may have a width of at least three times a width of the transmission line.

The low-pass filter may meet with the second pocket portion by a bordering area that equal to or wider than the open portion.

The first pocket portion may have a depth of at least three times a thickness of the dielectric material substrate.

The second pocket portion may have a depth of at least twice a thickness of the dielectric material substrate.

The cavity filter assembly may further include a first pocket cover disposed to structurally and electrically seal the first pocket portion.

The bandpass filter may include a dielectric material substrate, a bandpass filter circuit section established in a microstrip form on one surface of the dielectric material substrate, a ground pattern formed on the other surface of the dielectric material substrate, and an open portion formed by removing at least a portion of the ground pattern and overlapping at least a portion of the bandpass filter circuit section.

Advantageous Effects

The present disclosure can substantially reduce insertion loss by reducing parasitic capacitance between a ground and a transmission line of an RF filter, which connects an RF terminal and an internal resonance rod, and where the RF filter is a low-pass filter, the present disclosure can cause the harmonics of a stopband to be formed at a position farther from the cutoff frequency of the low-pass filter, thereby effecting an improved frequency characteristic of the low-pass filter.

BRIEF DESCRIPTION OF THE DRAWINGS

FIG. 14 is a graphical comparison of Q-factors of low-pass filters with, and without a second pocket portion included.

DETAILED DESCRIPTION

Figure 1:
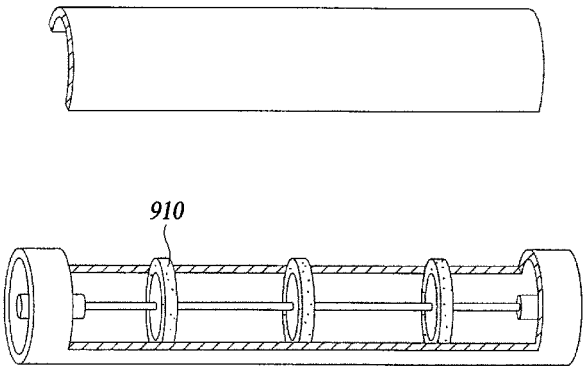
FIG. 1 (Prior Art)
FIG. 1 is a conceptual diagram of a conventional low-pass filter having a stepped-impedance of a coaxial type.
Figure 2:
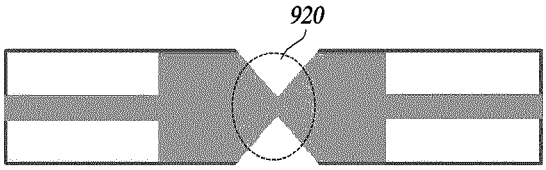
FIG. 2 (Prior Art)
FIG. 2 is a conceptual diagram of a conventional low-pass filter in which the middle structure between coaxial type stepped-impedance sections is modified to improve harmonic characteristics.

Hereinafter, some embodiments of the present disclosure will be described in detail with reference to the accompanying drawings. In the following description, like reference numerals designate like elements, although the elements are shown in different drawings. Further, in the following description of some embodiments, a detailed description of known functions and configurations incorporated therein will be omitted for the purpose of clarity and for brevity.

Additionally, various terms such as first, second, A, B, (a), (b), etc., are used solely for the purpose of differentiating one component from the other, not to imply or suggest the substances, the order or sequence of the components. Throughout this specification, when a part "includes" or "comprises" a component, the part is meant to further include other components, not to exclude thereof unless specifically stated to the contrary. The terms such as "unit," "module," and the like refer to one or more units for processing at least one function or operation, which may be implemented by hardware, software, or a combination thereof.

Figure 3:
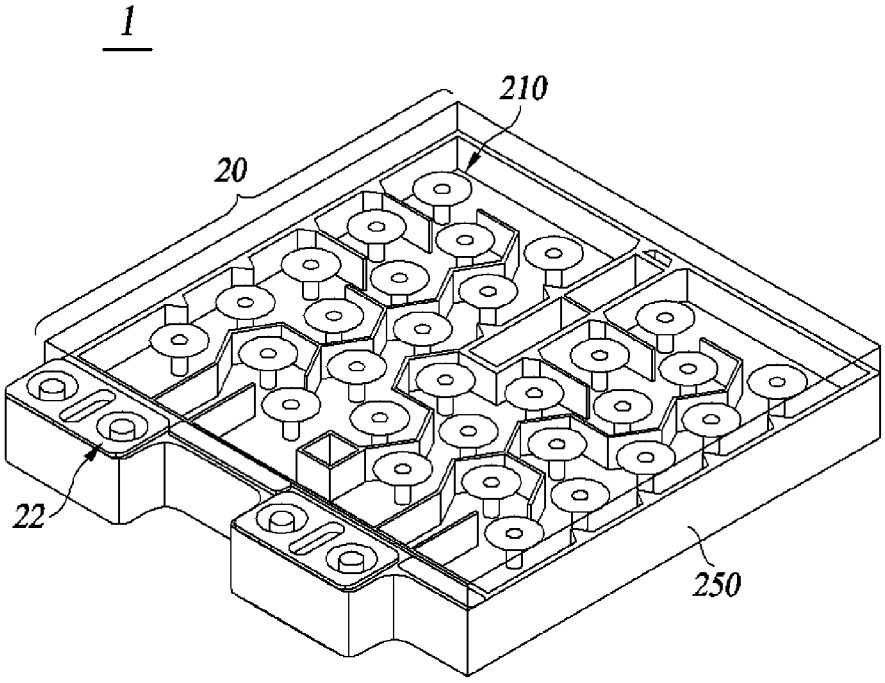
FIG. 3 is a perspective view of a cavity filter assembly, including a low-pass filter according to at least one embodiment of the present disclosure.

FIG. 3 is a perspective view of a cavity filter assembly illustrated by its principal part, including a low-pass (RF) filter according to at least one embodiment of the present disclosure.

According to at least one embodiment of the present disclosure, the cavity filter assembly has a container of a cavity filter 1 which internally has a hollow for housing resonance rods 210 disposed of therein, wherein the RF filter is adapted to connect an external signal connection (not shown) of the cavity filter 1 with the resonance rods 210.

In describing the present disclosure, the RF filter is described primarily, but not necessarily, as a low-pass (RF) filter and other types of filters having an exterior dimension like a bandpass (RF) filter are also included in the scope of the present disclosure.

Figure 4:
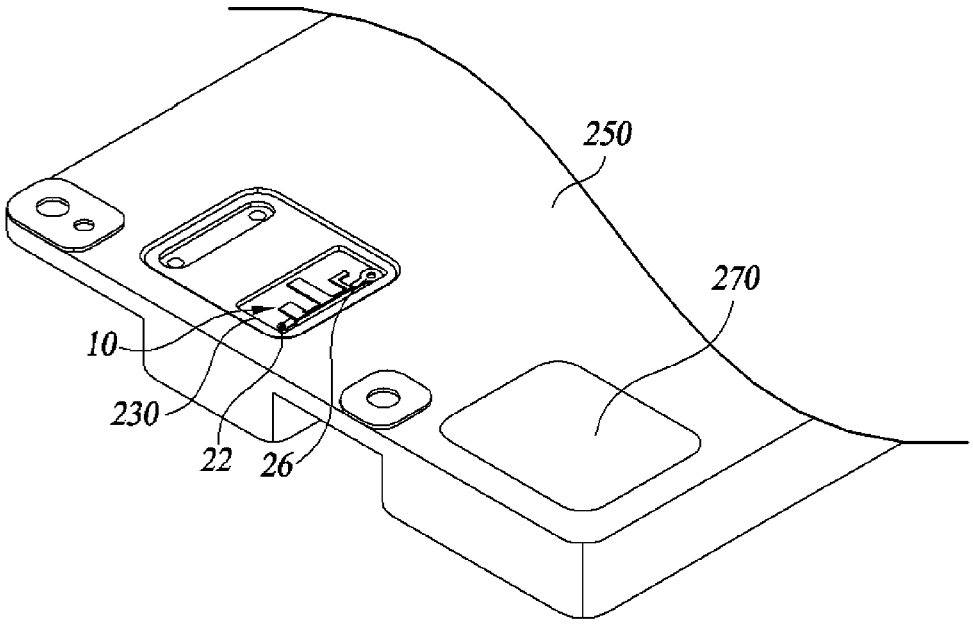
FIG. 4 is a partial rear perspective view of a cavity filter assembly, including a low-pass filter according to at least one embodiment of the present disclosure.

FIG. 4 is a partial rear perspective view of a cavity filter assembly, including a low-pass filter according to at least one embodiment of the present disclosure.

Figure 5:
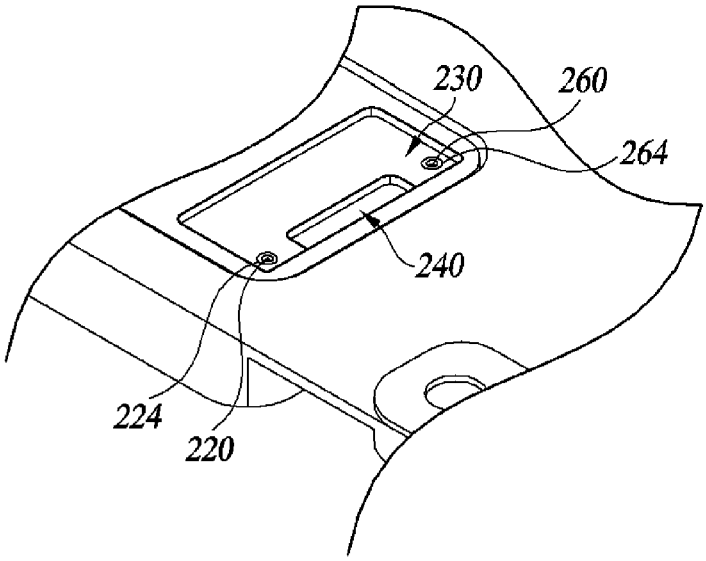
FIG. 5 is a rear perspective view showing a cavity filter assembly partially at a rear pocket portion before a low-pass filter is inserted therein, according to at least one embodiment of the present disclosure.

FIG. 5 is a rear perspective view showing a cavity filter assembly partially at a rear pocket portion before a low-pass filter is inserted therein, according to at least one embodiment of the present disclosure.

Figure 6:
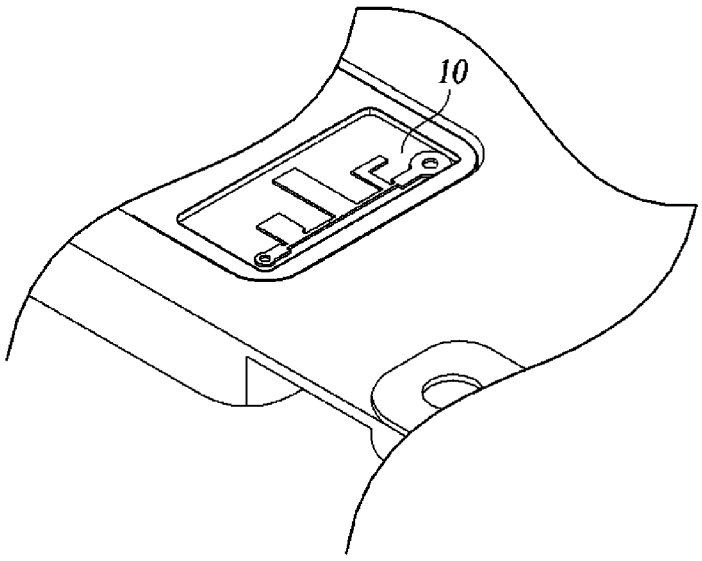
FIG. 6 is a rear perspective view showing a cavity filter assembly partially at a rear pocket portion with a low-pass filter inserted therein, according to at least one embodiment of the present disclosure.

FIG. 6 is a rear perspective view showing a cavity filter assembly partially at a rear pocket portion with a low-pass filter inserted therein, according to at least one embodiment of the present disclosure.

As shown in FIGS. 3 to 6, a cavity filter assembly according to at least one embodiment of the present disclosure includes a cavity filter 1 and a low-pass filter 10. The cavity filter 1 also includes a resonant section 20, including at least one resonating rod 210 and at least one RF connection member 22, 26. In addition, a cavity filter body 250 adjacent to the RF connection members 22 and 26 further includes a first pocket portion 230 formed to receive the low-pass filter 10. According to at least one embodiment of the present disclosure, the low-pass filter 10 connects the inner RF connection member 26 connected to the resonance rod 210 with the outer RF connection member 22 connected to an external signal.

According to at least one embodiment of the present disclosure, the cavity filter assembly further includes a second pocket portion 240 within the first pocket portion 230 formed to receive the low-pass filter 10 in the cavity filter body 250. The second pocket portion 240 is formed to define an air cavity in contact with at least a portion of the low-pass filter 10 to establish an air cavity between the low-pass filter 10 and the electrically grounded cavity filter body 250.

Adapted to link an RF signal outside of the cavity filter 1 with the resonant section 20 inside of the cavity filter 1, the low-pass filter 10 includes a dielectric material substrate 110, a transmission line 120 formed on one side of the dielectric material substrate 110, impedance matching sections 130 disposed at both ends of the transmission line 120, at least one open stub 140 which is arranged between the two impedance matching sections 130 and is connected to the transmission line 120, a ground pattern 150 which is formed on the other side of the dielectric material substrate 110, and an open portion 160 which is formed in the ground pattern 150 so that the transmission line 120 and the ground pattern 150 do not overlap.

The first pocket portion 230 formed on one surface of the cavity filter body 250 is structurally and electrically sealed by a first pocket cover 270, thereby completing the cavity filter assembly. The depth of the first pocket portion 230 is preferably greater than or equal to three times the thickness of the dielectric material substrate 110 to minimize the influence on an operating characteristic of the RF filter circuit and minimize parasitic capacitance between the first pocket cover 270.

The low-pass filter 10 according to at least one embodiment of the present disclosure distinctively arranges its open portion 160 to meet the second pocket 240 formed in the cavity filter body 250 and renders the air cavity formed by the second pocket 240 to substantially reduce the parasitic capacitance formed between the transmission line 120 and the electrically grounded cavity filter body 250, thereby improving the characteristics of the low-pass filter 10. In other words, to lower a parasitic capacitance value generated between the transmission line 120 and the ground, the cavity filter body 250 is formed with the second pocket portion 240 conforming to the substrate open portion 160 as vertically projected to the second pocket portion 240.

As shown in FIGS. 4 to 6, the low-pass filter 10 according to at least one embodiment of the present disclosure includes a microstrip form low-pass filter and the second pocket portion 240 formed in the cavity filter body 250 to provides an air cavity between the transmission line 120 and the ground.

The low-pass filter 10 is disposed of in the first pocket portion 230 formed on the opposite side of the side where an external RF connector (not shown) is plugged in, so that the low-pass filter 10 has one end electrically connected with the outer RF connection member 22 by its pin member 220 by soldering or the like, and the other end electrically connected with the inner RF connection member 26 connected to the resonance rod 210 of the cavity filter 1.

The low-pass filter 10 requires a small insertion loss of the passband based on the cutoff frequency and has its performance greatly affected by a frequency cutoff characteristic of the stopband. It is common for a high-frequency region of an actual stopband to generate a harmonic due to various factors. The higher (the farther) the frequency location of the harmonics from the cutoff frequency, the better. In addition, the smaller the frequency response characteristics of the harmonics, the more advantageous. As the fifth-generation (5G) or future technologies require increased antenna performance, the frequency cutoff characteristic of the stopband by the cavity filter needs to be superior to that of the past.

The most representative of the cause of the harmonic occurring in the stopband is parasitic capacitances which are present physically in the signal transmission line and are connected in series or parallel with the signal transmission line. Such a subtle difference of a line for transmitting an ultra-high frequency signal in terms of length and width of the transmission line 120, line spacing with the ground, impedance matching, and the like may lead to an inductance and a capacitance circuit formed in various sizes and orders. In particular, the parasitic capacitance of interest of the present disclosure is parasitic capacitance formed between the transmission line 120 and the ground in the low-pass filter 10, which is connected in parallel with the inductance of the transmission line 120, thereby forming an attenuation pole in the stopband in the frequency characteristic of the low-pass filter 10. The aforementioned parasitic capacitance is connected equivalently in series with the capacitance of the dielectric material substrate 110, which is determined by the dielectric constant and thickness of the dielectric material substrate 110, between the back of the dielectric material substrate 110, on which the stripline type transmission line 120 is formed. In other words, reducing the size of the parasitic capacitance can shrink the capacitance formed between the transmission line 120 and the ground, thereby inducing a unique frequency characteristic formed by the capacitance value to be positioned at a higher frequency level of the stopband.

A ground plane is generally disposed all over the rear surface of the transmission line 120. To vary the frequency response characteristic of the transmission line 120, a circuit configuration is provided for adding inductance and capacitance equivalently to the transmission line 120 through changing the flow of the return current by etching the ground pattern by including various forms of the transmission line 120 and a defect ground structure (DGS) on the rear surface of the transmission line 120.

Further to this idea, the present disclosure can greatly reduce the parasitic capacitance formed between the transmission line 120 and the ground portion of the cavity filter body 250 with the air cavity defined by the second pocket portion 240 by grooving the inside of the first pocket portion 230 of the cavity filter body 250, in which the low-pass filter 10 is disposed of. As a result, according to at least one embodiment of the present disclosure, the cavity filter 1 is structured to be the low-pass filter 10 to cause its harmonics occurring in the stopband to appear at a higher frequency level for further reducing the magnitude of the harmonics. According to at least one embodiment of the present disclosure, the low-pass filter 10 provides not only the improved frequency characteristics of reduced insertion loss and improved harmonic characteristics but also an advantageous miniaturization thereof. The low-pass filter 10 is capable of being tuned in various ways to the required characteristics of the cavity filter 1 and easily installed in the first pocket portion 230 of the cavity filter 1.

Figure 7:
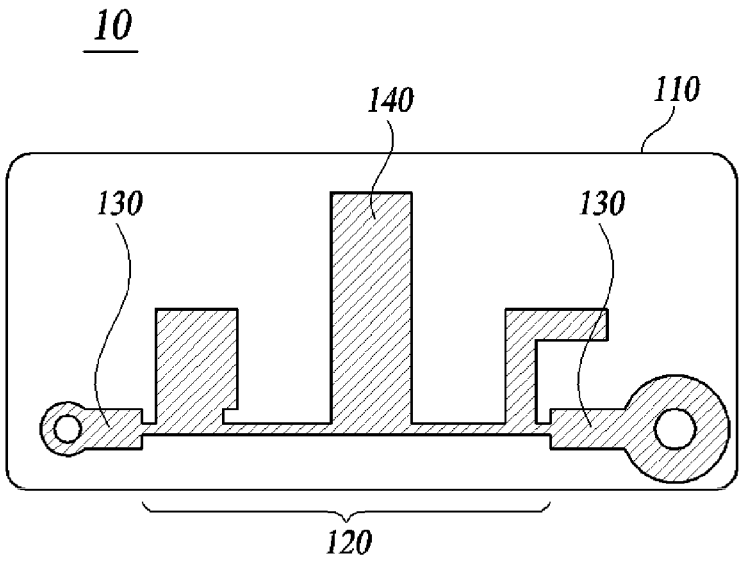
FIG. 7 is a plan view of a substrate part of a low-pass filter according to at least one embodiment of the present disclosure, illustrating a transmission line, an open stub, and impedance matching sections close to both side terminals.

FIG. 7 is a plan view of a substrate part of a low-pass filter according to at least one embodiment of the present disclosure, illustrating a transmission line, an open stub, and impedance matching sections close to both side terminals.

Figure 8:
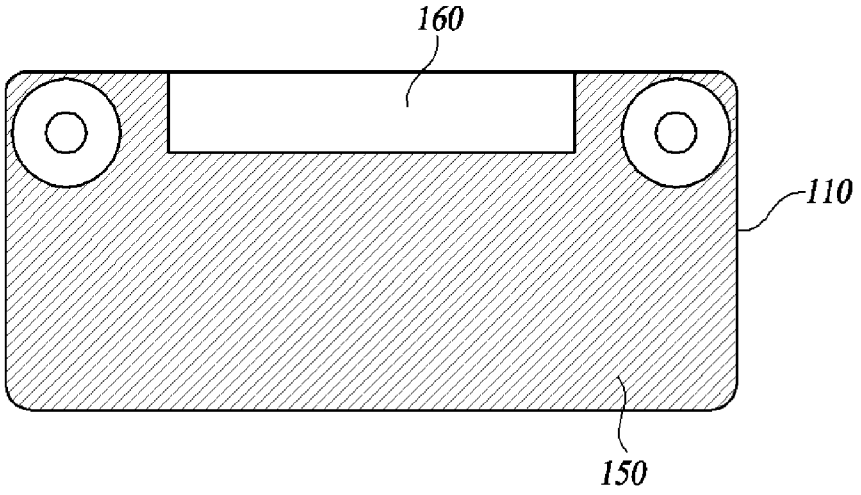
FIG. 8 is a rear view of a substrate part of a low-pass filter according to at least one embodiment of the present disclosure, illustrating a ground layer formed on the back of the substrate part and an open portion formed by etching the ground layer.

FIG. 8 is a rear view of a substrate part of a low-pass filter according to at least one embodiment of the present disclosure, illustrating a ground layer formed on the back of the substrate part and an open portion formed by etching the ground layer.

As shown as FIGS. 5 and 7, the low-pass filter 10 according to at least one embodiment of the present disclosure is made based on the dielectric material substrate 110 having one surface formed with opposite side terminal units, the impedance matching sections 130 formed adjacent to both terminal units, the transmission line 120 extending between the impedance matching sections 130, a low-pass filter circuit branched from the transmission line 120 and implemented by the open stub 140, and having the rear surface formed with the ground pattern 150 and the open portion 160 positioned corresponding to the transmission line 120 over an area wider than the transmission line 120 on the one surface by etching the ground pattern 150 to electrically open between the transmission line 120 and the air cavity in the second pocket portion 240.

According to at least one embodiment of the present disclosure, the length of the second pocket portion 240 is desirably greater than the distance between the impedance matching sections 130 of the low-pass filter 10. Further, as shown in FIGS. 5 and 8, the width of the opening 160 is desirably at least three times the width of the transmission line 120. In addition, the depth of the second pocket portion 240 is preferably greater than twice the thickness of the dielectric material substrate 110. The size of the second pocket portion 240 may be preferably determined to be in such range that does not degrade the characteristics of the low-pass filter 10 due to a structural resonance in the ultra-high frequency band of the second pocket portion 240 itself.

Figure 9:
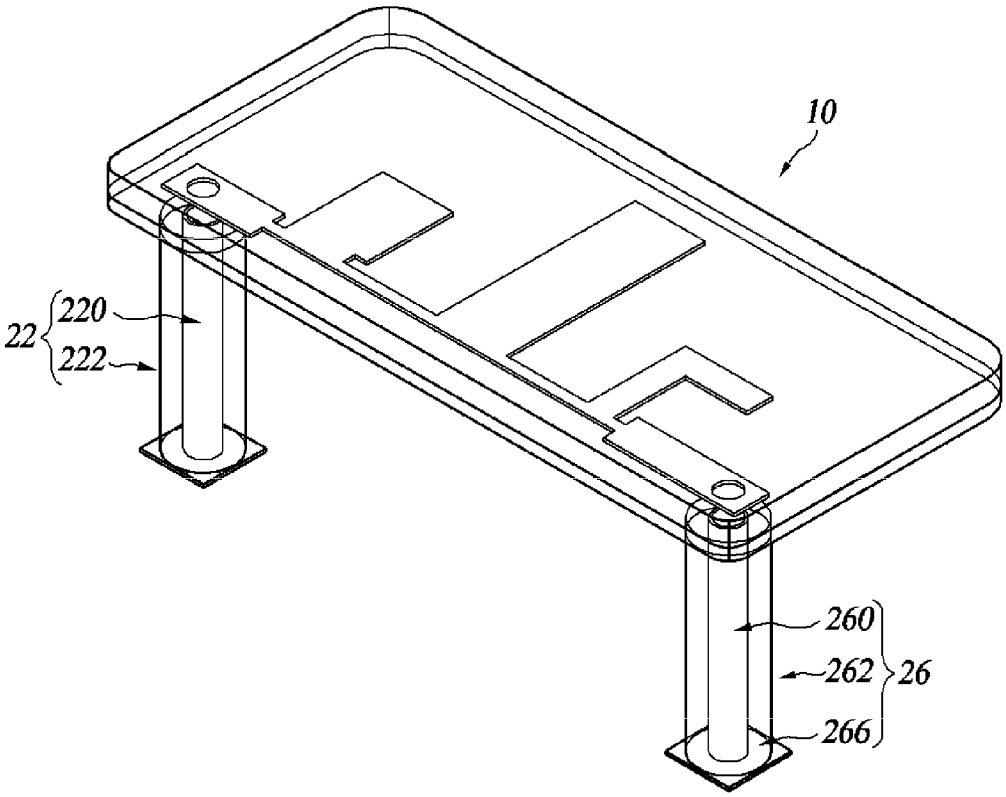
FIG. 9 is a modeling diagram for computational simulation of a plain low-pass filter without a second pocket portion provided.

FIG. 9 is a modeling diagram for computational simulation of a plain low-pass filter without a second pocket portion provided.

Figure 10:
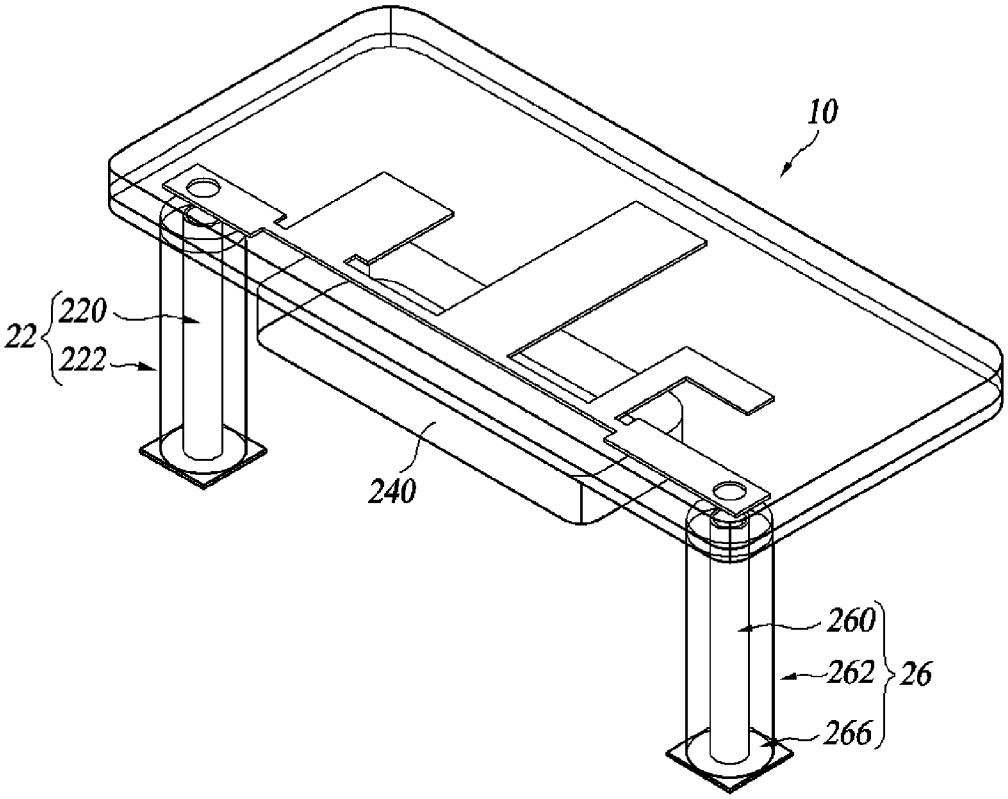
FIG. 10 is a modeling diagram for computational simulation of a low-pass filter provided with a second pocket portion according to at least one embodiment of the present disclosure.

FIG. 10 is a modeling diagram for computational simulation of a low-pass filter provided with a second pocket portion according to at least one embodiment of the present disclosure.

As shown in FIGS. 9 and 10, the two models for computational simulation have the same size, of which the model of FIG. 9 is formed without a second pocket portion 240 such that the low-pass filter 10 has a ground layer disposed entirely on the rear surface of the substrate part thereof. The present model of low-pass filter 10 according to at least one embodiment includes both the ground pattern 150 and the opening 160 on the rear surface of the substrate part thereof, and it is provided with the second pocket portion 240 of the corresponding size and at a corresponding position to the opening 160.

As shown in FIGS. 9 and 10, the RF connection members 22 and 26 of the cavity filter include dielectric bushes 222 and 262 assembled to through-holes 224 and 264 in the cavity filter, and pin members 220 and 260 assembled to the dielectric bushes 222 and 262 and connected to the low-pass filter 10. The resonant section 20 and the low-pass filter 10 are interconnected by the pin member 260 of the inner RF connection member 26 disposed of in the through-hole 264 proximal to the resonant section 20. In at least one embodiment, the pin member 260 has an end 266, which extends through the through-hole 264 to be exposed to the hollow formed internally of the container of the cavity filter 1 and electrically connected to an adjacent resonance rod 210 disposed of in the interior hollow. The outer RF connection member 22 has an end, which is disposed at a position remote from the resonance unit 20 and received an external RF signal linked thereto.

Although FIG. 9 and FIG. 10 illustrate a rectangular shape of the dielectric material substrate 110, the present disclosure is not limited to this shape, but the dielectric material substrate 110 may be reshaped to have an irregular-sided structure, for example, to surround the open stub 140 offsetting the outline of the open stub 140. The first pocket portion 230 may be made to conform to the reshaped dielectric material substrate. Generally, rectangular shapes of filter substrate may be desirably fabricated for easy replacement of filters such as bandpass filters having various shapes and frequency cutoff characteristics.

Figure 11:
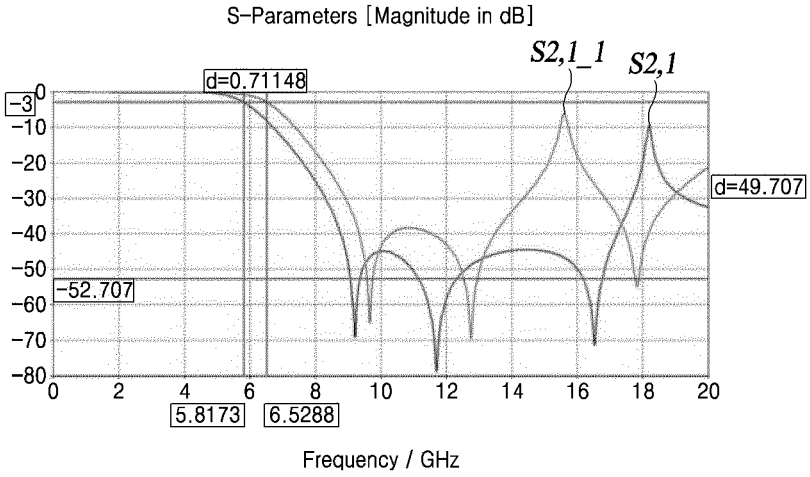
FIG. 11 is a graphical comparison of analyzed frequency characteristics of low-pass filters with, and without a second pocket portion included.

FIG. 11 is a graphical comparison of analyzed frequency characteristics of low-pass filters with, and without a second pocket portion included.

Figure 12:
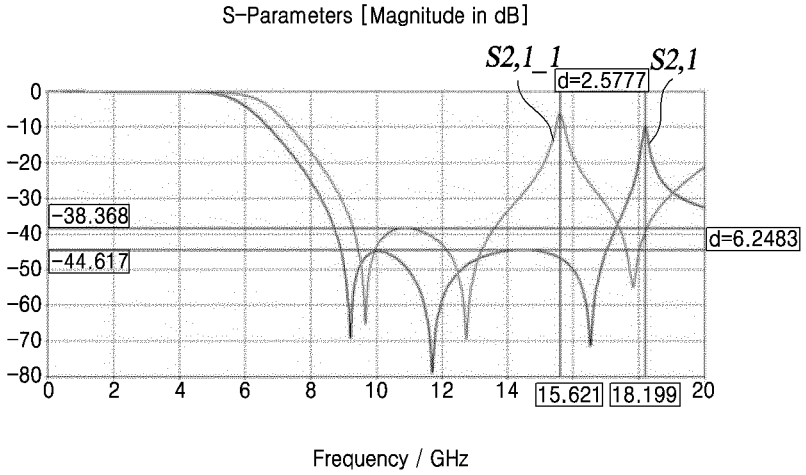
FIG. 12 is a graphical comparison of harmonic characteristics of stopbands of low-pass filters with, and without a second pocket portion included.

FIG. 12 is a graphical comparison of harmonic characteristics of stopbands of low-pass filters with, and without a second pocket portion included.

Figure 13:
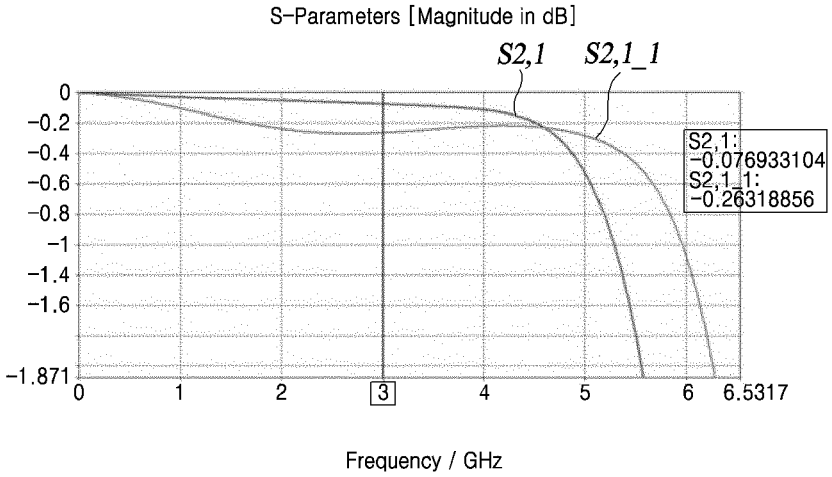
FIG. 13 is a graphical comparison of analyzed insertion losses of low-pass filters with, and without a second pocket portion included.

FIG. 13 is a graphical comparison of analyzed insertion losses of low-pass filters with, and without a second pocket portion included.

In FIGS. 11 through 13, the results as indicated by S2,1 are those of the low-pass filter 10 provided with the second pocket unit 240 according to the embodiment of the present disclosure as illustrated in FIG. 10, and the results as indicated by S2,1_1 are those of a plain low-pass filter 10 without the second pocket portion 240 provided, as illustrated in FIG. 9.

As shown in FIG. 11, in the frequency response characteristics of the low-pass filter 10 with and without a second pocket portion 240 included, the cutoff frequency characteristic was analyzed to be 5.8 GHz at the presence of the second pocket portion 240 as compared to 6.5 GHz without the second pocket portion 240.

As shown in FIG. 12, the frequency response characteristic in the stopband after the skirt exhibited a greater attenuation of about 6 dB with the second pocket portion 240 present compared to the case lacking the second pocket portion 240, which confirms the improvement of the basic cutoff performance in the stopband. In addition, the position of the harmonic by the inductance element of the low-pass filter 10 was analyzed to be 18.1 GHz for a design according to at least one embodiment of the present disclosure formed with the second pocket portion 240 as compared to 15.6 GHz for an existing design without the second pocket portion 240. When compared based on the cutoff frequency and the harmonic frequency, the low-pass filter 10 according to at least one embodiment of the present disclosure has a first stopband width of 9.1 GHz from 6.5 GHz to 15.6 GHz against the width of 12.3 GHz from 5.8 GHz to 18.1 GHz according to an existing design. Therefore, the low-pass filter design, according to at least one embodiment of the present disclosure, can be confirmed as a substantial improvement in terms of both the attenuation and bandwidth characteristics in the stopband.

As shown in FIG. 13, it can be seen that the low-pass filter 10 according to at least one embodiment has very little insertion loss in the passband, and also has a very good flatness of the passband but does not distort linearity. It can be seen that the insertion loss measured by analysis at 3 GHz is 0.263 dB for the existing design without the second pocket portion 240, to which the design according to at least one embodiment provided with the second pocket portion 240 exhibits the insertion loss of 0.076 dB, resulting in an improved characteristic by 0.186 dB.

The design according to at least one embodiment of the present disclosure secures an insertion loss within 0.1 dB in the main frequency region of a passband and thereby achieves a cavity filter assembly technique having a low-pass filter 10 for providing a performance to live up to the environment such as next-generation mobile communications needing much better frequency characteristics. In addition, the performance improvement involves none of the complex, complicated pattern design or deformation in the dielectric material substrate 110 but simply forming the second pocket portion 240 added to the basic grooving for placing the low-pass filter 10 in the cavity filter body 250 to achieve a significant level of performance improvement. In addition, the present disclosure needs no significant design change in the cavity filter body 250 to provide a separate space for forming the second pocket portion 240, except a simple removal of some unused inner space of the cavity filter body 250, that is immediately applicable to most cavity filter structures.

In particular, the low-pass filter 10 according to at least one embodiment of the present disclosure has not only an improved frequency response characteristics but also a straightforward structure for simplification and miniaturization, which is beneficial to convenient installation jobs of, for example, frequency characteristic tuning, various tests, and maintenance of cavity filters corresponding to various frequency bands by different wireless and mobile communications providers.

FIG. 14 is a graphical comparison of Q-factors of low-pass filters with, and without a second pocket portion included.

The existing design without the second pocket portion 240 has a Q-factor of 213, whereas the present design, according to at least one embodiment formed with the second pocket portion 240 has a Q-factor of 229, showing yet another improvement to offer.

Although exemplary embodiments of the present disclosure have been described for illustrative purposes, those skilled in the art will appreciate that various modifications, additions, and substitutions are possible, without departing from the idea and scope of the claimed invention. Therefore, exemplary embodiments of the present disclosure have been described for the sake of brevity and clarity. The scope of the technical idea of the present embodiments is not limited by the illustrations. Accordingly, one of ordinary skill would understand the scope of the claimed invention is not to be limited by the above explicitly described embodiments but by the claims and equivalents thereof.

The invention claimed is:

1. A cavity filter assembly, comprising:

a cavity filter, comprising:

a hollow container including a first pocket formed on one surface of the cavity filter and a second pocket formed on a first region of a bottom surface of the first pocket; and one or more resonant rods positioned within the hollow container;

a radio frequency (RF) filter disposed within the first pocket; and one or more RF connection members coupled to the RF filter on a second region of the bottom surface of the first pocket, wherein the hollow container further comprises:

at least one through-hole formed in the second region of the bottom surface of the first pocket.

2. The cavity filter assembly of claim 1, wherein the RF connection members comprise:

a dielectric bush assembled to the at least one through-hole; and a pin member assembled to the dielectric bush and connected to the RF filter.

3. The cavity filter assembly of claim 2, wherein the RF filter has one end connected to one of the resonant rods by the pin member disposed adjacent to the one of the resonant rods.

4. The cavity filter assembly of claim 3, wherein the RF filter has another end to which an external RF signal is transmitted through another pin member connected with the another end of the RF filter.

5. The cavity filter assembly of claim 1, wherein the RF filter comprises a low-pass filter.

6. The cavity filter assembly of claim 5, wherein the low-pass filter comprises:

a dielectric material substrate;

a transmission line formed in a microstrip format on one surface of the dielectric material substrate;

impedance matching sections disposed at both ends of the transmission line;

at least one open stub disposed between the impedance matching sections and connected to the transmission line;

a ground pattern formed on another surface of the dielectric material substrate; and an opening formed by removing at least a portion of the ground pattern and overlapping an area of the transmission line.

7. The cavity filter assembly of claim 6, wherein the opening is provided to overlap an entire area of the transmission line.

8. The cavity filter assembly of claim 6, wherein the opening has a width of at least three times a width of the transmission line.

9. The cavity filter assembly of claim 6, wherein the low-pass filter meets with the second pocket by a bordering area that is equal to or wider than the opening.

10. The cavity filter assembly of claim 6, wherein the first pocket has a depth of at least three times a thickness of the dielectric material substrate.

11. The cavity filter assembly of claim 6, wherein the second pocket has a depth of at least twice a thickness of the dielectric material substrate.

12. The cavity filter assembly of claim 6, further comprising:

a first pocket cover disposed to structurally and electrically seal the first pocket.

13. The cavity filter assembly of claim 1, wherein the RF filter comprises a bandpass filter.

14. The cavity filter assembly of claim 13, wherein the bandpass filter comprises:

a dielectric material substrate;

a bandpass filter circuit section formed in a microstrip format on one surface of the dielectric material substrate;

a ground pattern formed on an another surface of the dielectric material substrate; and an opening formed by removing at least a portion of the ground pattern and overlapping at least a portion of the bandpass filter circuit section.

15. A cavity filter, comprising:

a container including a first pocket and a second pocket formed under the first pocket in a vertical direction, wherein a cross-sectional area of the first pocket is larger than a cross-sectional area of the second pocket;

at least one resonant rod disposed in the container; and a radio frequency (RF) filter disposed in the first pocket, wherein the at least one resonant rod is oriented in the vertical direction, and wherein the container comprises:

a through-hole penetrating a bottom surface of the first pocket, wherein the through-hole does not penetrate a bottom surface of the second pocket.

16. The cavity filter of claim 15, further comprising:

a dielectric bush provided in the through-hole; and a pin provided in the dielectric bush and connected to the RF filter.

17. The cavity filter of claim 16, wherein the RF filter has one end connected to the resonant rod by the pin.

18. The cavity filter of claim 17, wherein the RF filter has another end to which an external RF signal is transmitted through another pin connected with the another end of the RF filter.

* * * * *